United States Patent [19]

Morita et al.

[11] Patent Number: 4,520,544

[45] Date of Patent: Jun. 4, 1985

[54] METHOD OF AND APPARATUS FOR AUTOMATICALLY FINISHING SLIDE FASTENERS

[75] Inventors: Toyoo Morita, Uozu; Yoichi Horikawa, Kurobe, both of Japan

[73] Assignee: Yoshida Kogyo K. K., Tokyo, Japan

[21] Appl. No.: 552,312

[22] Filed: Nov. 16, 1983

[30] Foreign Application Priority Data

Nov. 16, 1982 [JP] Japan ..... 57-173471
Dec. 7, 1982 [JP] Japan ..... 57-214183

[51] Int. Cl.[3] ..... B21D 53/50
[52] U.S. Cl. ..... 29/408; 29/766
[58] Field of Search ..... 29/408–410, 29/766–770, 33.2

[56] References Cited

U.S. PATENT DOCUMENTS 3,947,046 4/1976 Omori et al. ..... 29/408
4,307,500 12/1981 Kuse ..... 29/408
4,369,560 1/1983 Ueda ..... 29/408

*Primary Examiner*—Howard N. Goldberg
*Assistant Examiner*—Steven Nicholas
*Attorney, Agent, or Firm*—Hill, Van Santen, Steadman & Simpson

[57] ABSTRACT

A slide fastener chain is fed along a chain path by a feedout mechanism until a leading end of the chain gripped by the feedout mechanism reaches a first feeder mechanism past a cutting mechanism. The first feeder mechanism is then actuated to feed the chain toward a second feeder mechanism. The first feeder mechanism is then inactivated and the second feeder mechanism is actuated to feed the chain at a higher speed. A slider on the chain is engaged by a slider sensor to intermesh element rows on the chain as it is transported by the second feeder mechanism. Then, a chain stop of a stop mechanism is inserted into an element-free gap in the chain and engaged by a bottom stop following the element-free gap to stop the travel of the chain. The second feeder mechanism is released and the cutting mechanism is actuated to cut off the chain across the element-free gap to produce a slide fastener, which is discharged by the second feeder mechanism into a sorting mechanism. Any defective slide fastener length having no slider is rejected by the sorting mechanism, and complete slide fasteners are delivered into a storage mechanism from which they can be picked up.

8 Claims, 17 Drawing Figures

METHOD OF AND APPARATUS FOR AUTOMATICALLY FINISHING SLIDE FASTENERS

BACKGROUND OF THE INVENTION

1. Field of the Invention

The present invention relates to a method of and an apparatus for automatically finishing slide fasteners by cutting off an elongate, substantially endless slide fastener chain at longitudinally spaced element-free gaps therein across the slide fastener stringer tapes.

2. Description of the Prior Art

Prior apparatus for finishing slide fasteners includes two pairs of feed rollers and a cutter disposed between the feed roller pairs on a path of travel of a slide fastener chain. In operation, the feed rollers are stopped to arrest the movement of the slide fastener chain when an element-free gap therein reaches the cutter, and the cutter is actuated to sever the slide fastener chain across the element-free gap, followed by the driving of the feed rollers.

The slide fastener chain from which a slide fastener has been cut off is fed downstream along the path by being pushed by the pair of feed rollers positioned upstream of the cutter until the leading end of the chain arrives at the cutter, while the completed slide fastener is discharged by the pair of feed rollers located downstream of the cutter. Since the slide fastener chain, especially the tapes thereof, is relatively flexible, the apparatus has chain guides located upstream and downstream of the cutter for guiding the slide fastener chain properly along the path to prevent the chain from being jammed in the cutter. Nevertheless, the leading end of the slide fastener chain, as it moves from the upstream guide to the downstream guide, is liable to become jammed at the inlet of the downstream guide.

SUMMARY OF THE INVENTION

It is an object of the present invention to provide a method of and an apparatus for automatically finishing slide fasteners while allowing a slide fastener chain to be fed in the apparatus reliably and smoothly without the use of chain guides until its leading end reaches a downstream feed roller past a cutter without being jammed.

Another object of the present invention is to provide a method of and an apparatus for automatically finishing slide fasteners by cutting off a slide fastener chain exactly at element-free gaps therein which may be longitudinally spaced at either uniform or non-uniform distances.

Still another object of the present invention is to provide a method of and an apparatus for automatically finishing slide fasteners by cutting off a slide fastener chain when the latter is stopped, with the chain being automatically closed by sliders mounted thereon while the chain is being fed through the apparatus.

According to the present invention, a slide fastener chain is fed along a chain path by being gripped by a feedout mechanism until a leading end of the chain reaches a first feeder mechanism past a cutting mechanism. The first feeder mechanism is then actuated to feed the chain toward a second feeder mechanism. Press rollers of the first feeder mechanism are then spaced from associated feed rollers, and the second feeder mechanism is actuated to feed the chain at a higher speed. A slider on the chain is engaged by a slider sensor to intermesh uncoupled element rows on the chain as it is transported by the second feeder mechanism. Then, a chain stop of a stop mechanism enters an element-free gap in the chain and is engaged by a bottom stop following the element-free gap, whereupon the stop mechanism stops the travel of the chain. The second feeder mechanism is released and the slide fastener chain is slightly moved back, followed by actuation of a cutting mechanism to cut off the chain across the element-free gap. A cut-off slide fastener is discharged by the second feeder mechanism into a sorting mechanism. Any defective slide fastener length having no slider thereon is rejected, by the sorting mechanism, to enter a storage mechanism, and complete slide fasteners having sliders thereon are delivered into the storage mechanism from which they can be picked up.

Many other advantages, features and additional objects of the present invention will become manifest to those versed in the art upon making reference to the detailed description and the accompanying sheets of drawings in which a preferred embodiment incorporating the principles of the present invention is shown by way of illustrative example.

DETAILED DESCRIPTION

Figure 1:
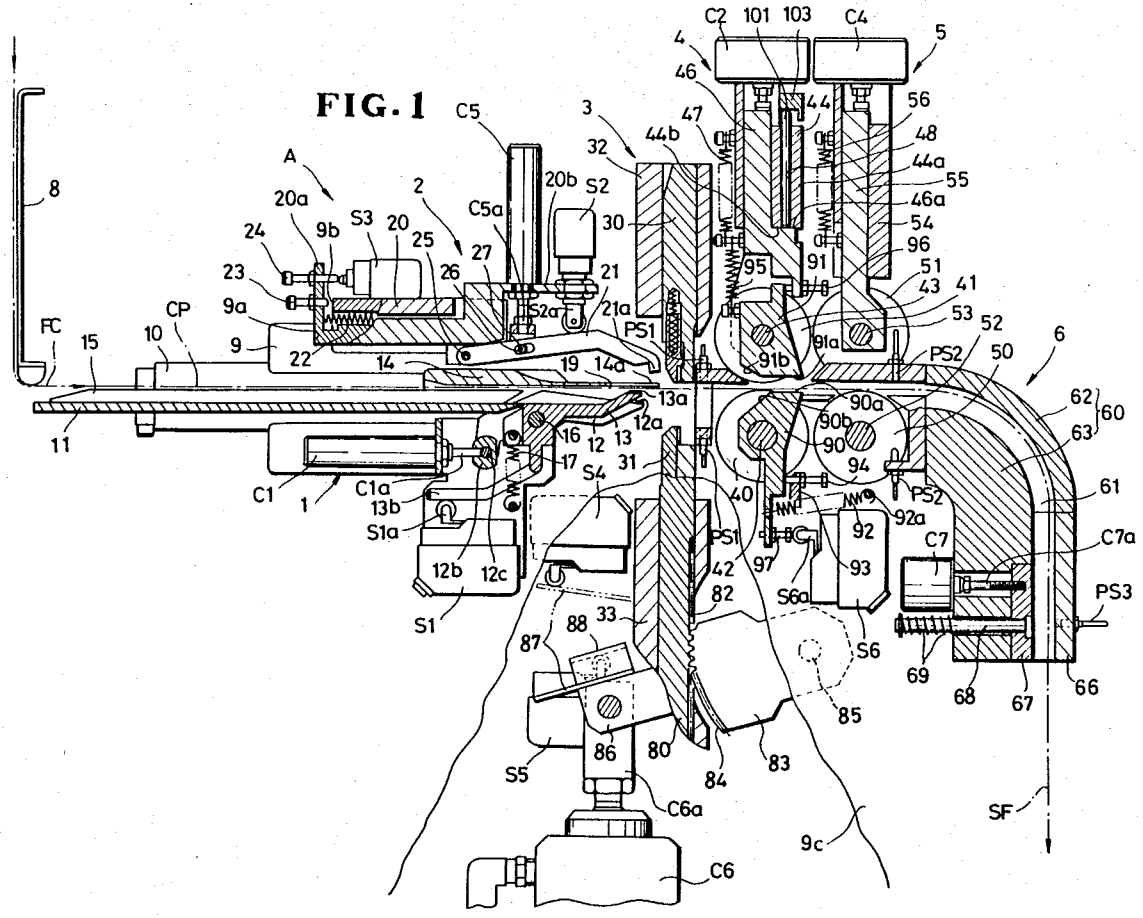
FIG. 1 is a vertical cross-sectional view of an apparatus for automatically finishing slide fasteners according to the present invention.

The present invention is particularly useful when embodied in an apparatus A, for automatically finishing slide fasteners, as illustrated in FIG. 1.

The apparatus A is basically composed of a feedout mechanism 1 for feeding out a slide fastener chain FC, a stop mechanism 2 for stopping the slide fastener chain FC, a cutting mechanism 3 for cutting off the slide fastener chain FC into individual slide fasteners, a first feeder mechanism 4 disposed downstream of the cutting mechanism 3 for feeding the slide fasteners, a second feeder mechanism 5 located downstream of the first feeder mechanism 4 for discharging the slide fasteners, a sorting mechanism 6 for sorting out complete slide fasteners as slide fastener products SF, rejecting defective slide fasteners, and a storage mechanism 7 (FIG. 9) following the sorting mechanism 6 for storing the slide fastener products SF coming from the sorting mechanism 6.

Figure 13:
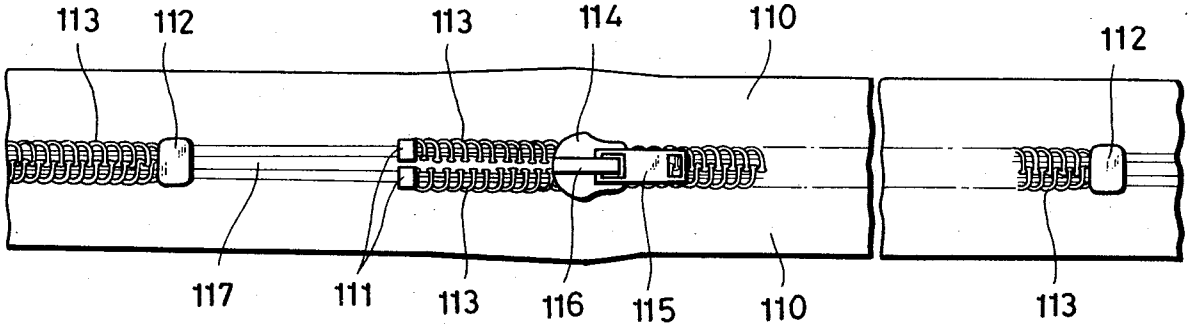
FIG. 13 is a fragmentary plan view of a slide fastener chain from which slide fasteners are produced.

The slide fastener chain FC which will be processed by the apparatus A into slide fastener products is illustrated in FIG. 13. The slide fastener chain FC comprises a pair of elongate slide fastener stringer tapes 110, 110 supporting thereon a plurality of paired rows of coupling elements 113, 113 longitudinally spaced along the stringer tapes 110, 110 with element-free gaps 117 therebetween. Each pair of the coupling element rows 113, 113 has a pair of top stops 111, 111 secured to one end thereof and a bottom stop 112 secured to the other end. The coupling element rows 113, 113 of each pair can be brought into and out of mutual intermeshing engagement by a slider 114 threaded on the coupling element rows 113, 113, the slider 114 having a pull tab 115 pivotably attached to a pull tab attachment 116. The slide fastener chain FC, with the bottom stops 112 located downstream of the top stops 111, 111 on the same element rows, is introduced into the apparatus A along a vertical guide plate 8 (FIG. 1).

The feedout mechanism 1 is operative to feed the slide fastener chain FC into the first feeder mechanism 4 through the cutting mechanism 3 by gripping the leading end of the slide fastener chain FC. The feedout mechanism 1 comprises a slidable ram 10 (FIGS. 1 through 3) slidably mounted on an apparatus frame 9 for movement along a path of travel CP (hereinafter referred to as "chain path CP") of the slide fastener chain FC. The slidable ram 10 supports thereon an elongate chain guide 11, a pair of grippers 12, 12 for gripping the leading end of the slide fastener chain FC, a slider sensor 13 disposed between the grippers 12, 12 for detecting a slider on the slide fastener chain FC, and a bearing plate 14 disposed above both the grippers 12, 12 and the slider sensor 13.

Figure 2:
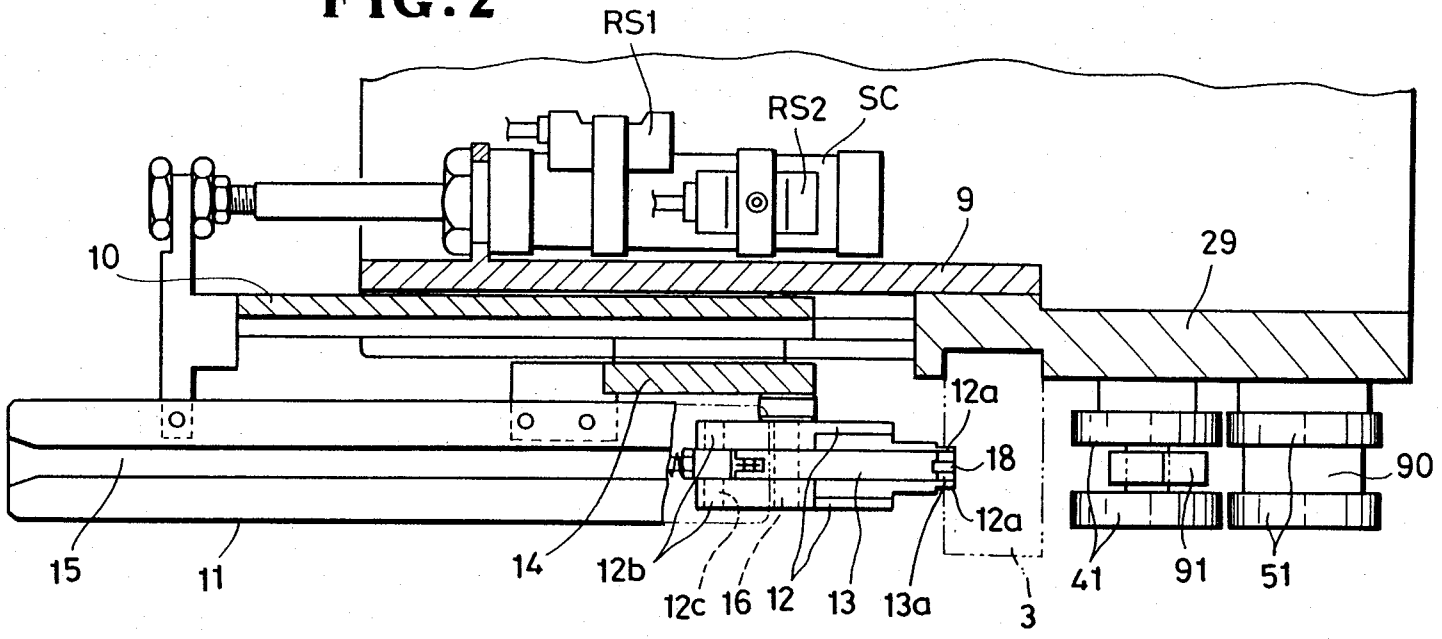
FIG. 2 is a plan view, partly in cross section, of a feedout mechanism and a stop mechanism of the apparatus of FIG. 1.
Figure 3:
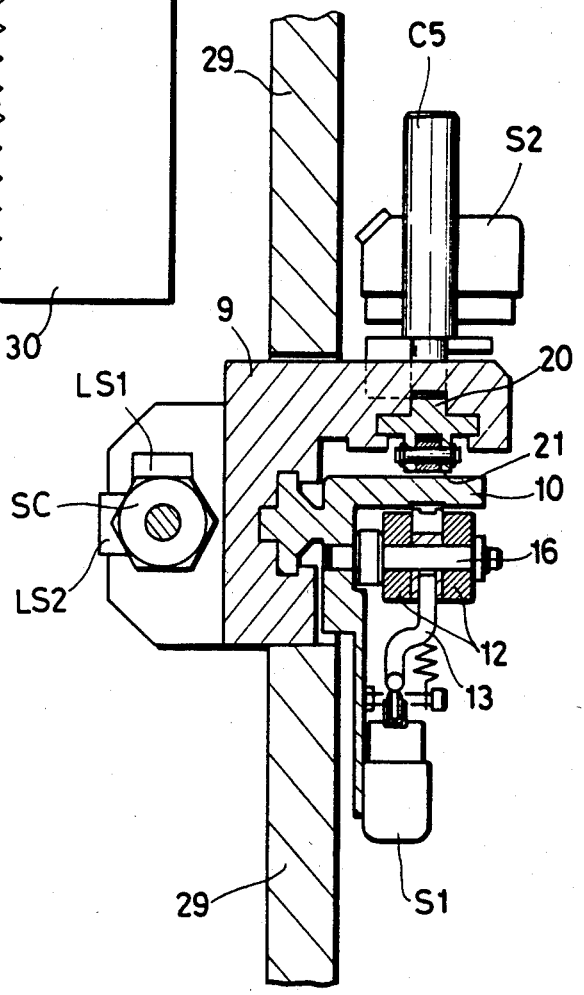
FIG. 3 is a side elevational view, partly in cross section, of the feedout and stop mechanisms of FIG. 2.

The chain guide 11 extends along a horizontal path of travel CP of the slide fastener chain FC, and as illustrated in FIG. 2, the chain guide 11 has a longitudinally extending and upwardly opening guide groove 15 for guiding the slider 114.

The grippers 12 and the slider sensor 13 are rotatably supported on a shaft 16 mounted on the slidable ram 10 at a downstream portion thereof below the chain path CP and immediately downstream of the chain guide 11. The grippers 12 are laterally spaced from each other transversely across the chain path CP. The grippers 12, 12 have distal ends 12*a*, 12*a*, respectively, extending downstream and terminating short of the cutting mechanism 3. When the grippers 12, 12 are operated, the distal ends 12*a*, 12*a* thereof are angularly moved toward the bearing plate 14 to grip the leading ends of the stringer tapes 110 of the slide fastener chain FC. The grippers 12, 12 have rear ends 12*b*, 12*b* interconnected by a pin 12*c* connected to a piston rod C1*a* of a fluid-pressurized cylinder C1 mounted on the slidable ram 10. The distal ends 12*a*, 12*a* of the grippers 12, 12 are normally retracted out of the chain path CP, as shown in FIG. 1. When the slide fastener chain FC is to be fed out, the grippers 12, 12 are angularly moved counterclockwise (FIG. 1) about the shaft 16 by the cylinder C1 to enable the distal ends 12*a*, 12*a* to hold the stringer tapes against the bearing plate 14.

The slider sensor 13 serves as a first chain closing mechanism. The slider sensor 13 has a distal end 13*a* for contacting a slider 114 threaded on the slide fastener chain FC. The slider sensor 13 is normally urged by a spring 17 to force the distal end 13*a* into a path of movement of the sliders 114. The slider sensor 13 also has a rear end 13*b* held in engagement with an actuator rod S1*a* of a limit switch S1 that is actuatable in response to angular movement of the slider sensor 13 to detect when a slider 112 acts on the distal end 13*a* of the slider sensor 13. The limit switch S1 is mounted on the slidable ram 10. As shown in FIG. 2, the distal end 13*a* of the slider sensor 13 has a recess 18 receptive of both the pull tab 115 and the pull tab attachment 116 (FIG. 13) so that the slider sensor 13 will be angularly moved through only a small angular space when it engages a slider 114.

As shown in FIG. 1, the bearing plate 14 is positioned upwardly of the chain path CP and is integral with the chain guide 11 at one side thereof. The bearing plate 14 has a distal end 14*a* extending downstream beyond the gripper ends 12*a* into the cutting mechanism 3. The distal end 14*a* is divided into a pair of lateral arms (one shown in FIG. 1) by a central recess 19 slightly wider than the sliders 114, the lateral arms being vertically aligned with the respective gripper ends 12*a* across the chain path CP.

As illustrated in FIG. 2, a fluid-pressurized sensor cylinder SC is mounted on the frame 9 and has a piston rod fixed to the slidable ram 10. First and second reed switches RS1, RS2 are fastened to the sensor cylinder SC by metal bands for detecting when a piston of the sensor cylinder SC is in an advanced position and a retracted position, respectively. When the slide fastener chain FC is to be fed along the chain path FC, the sensor cylinder SC is actuated to advance and then retract the slidable ram 10, and hence the chain guide 11, the grippers 12, the slider sensor 13, the bearing plate 14, the cylinder C1, and the limit switch S1.

In FIG. 1, the stop mechanism 2 is composed of a base 20 slidably mounted on the frame 9 for movement along the chain path CP and having a chain stop 21 pivotably mounted on the base 20 for vertical movement into and out of the chain path CP. The base 20 is normally urged by a spring 22 to move upstream into abutment against a first stop surface 9*a* of the frame 9. The base 20 has a rear or upstream vertical wall 20*a* through which a stop bolt 23 and a sensor bolt 24 threadedly extend. When the base 20 is moved downstream, the stop bolt 23 is brought into engagement with a second stop surface 9*b* of the frame 9 to thereby limit the advancing movement of the base 20. The tip end of the bolt 23 is spaced about 2 mm from the second stop surface 9*b* when the base 20 is in the rearmost upstream position. A limit switch S3 is mounted on the base 9 and coacts with the sensor bolt 24 for detecting the advancing and retracting movements of the base 20. The base 20 also includes a horizontal wall 20*b* extending downstream of the vertical wall 20*a*. Mounted on the horizontal wall 20*b* are a fluid-pressurized cylinder C5 for tilting the chain stop 21 and a limit switch S2 for detecting the return of the chain stop 21.

The chain stop 21 is angularly movably mounted by a shaft 25 on the base 20 so that a downwardly directed distal end 21*a* of the chain stop 21 can be moved into and out of the chain path CP through the recess 19 in the bearing plate 14. The chain stop 21 has a substantially central transverse slot 26 through which a pin 27 extends, the pin 27 being coupled to a piston rod C5*a* of the cylinder C5. The chain stop 21 is normally positioned by the cylinder C5 to retract the distal end 21*a* out of the chain path CP. The limit switch S2 has an actuator rod S2*a* held in contact with an upper surface of the chain stop 21. When the chain stop 21 is in its raised position, the limit switch S2 is energized to enable the feed of the fastener chain FC. When the chain stop 21 is in its lowered position, the limit switch S2 is deenergized to terminate the feed of the fastener chain FC.

As shown in FIG. 1, the cutting mechanism 3 comprises a pair of upper and lower cutter blades 30, 31 that is coactive to cut off the slide fastener chain FC. As shown in FIGS. 5A through 5D, the upper cutter blade 30 is fixed to a fixed holder 32, and the lower cutter blade 31 is fastened by a screw 81 to a movable member 80 vertically movably supported in a holder 33 (FIG. 1).

Figures 4A, 4B:
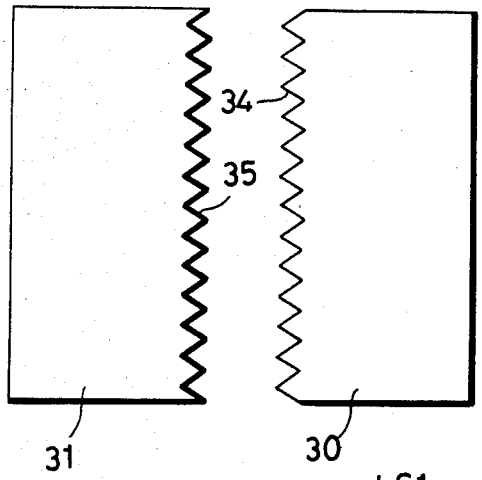
FIG. 4A is a bottom view of an upper cutter blade.
FIG. 4B is a plan view of a lower cutter blade.
Figure 5A:
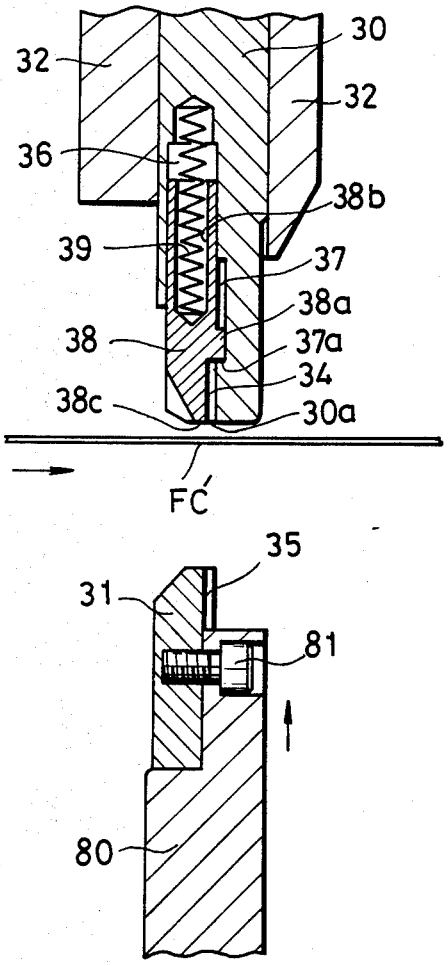
FIGS. 5A through 5D are vertical cross-sectional views of a cutting mechanism, showing the manner in which a slider fasten chain is cut off.

The upper cutter blade 30 has a serrated cutter edge 34 (FIG. 4B). The lower cutter blade 31 has a serrated cutter edge 35 (FIG. 4A). The serrated cutter edges 34, 35 are complementary in shape to each other. The cutter edge 34 is located downstream of the cutter edge 35, as shown in FIGS. 5A through 5D. The upper cutter blade 30 has a vertically extending and downwardly opening blind hole 36 for receiving therein a presser pad 38 and a spring 39. The presser pad 38 has an upper portion vertically slidable in the hole 36 and a projection 38*a* extending downstream and slidably disposed in a guide groove 37 defined in the upper cutter blade 30 below the hole 36, the upper portion having a blind hole 38*b* in which a compression spring 39 is mounted. The presser pad 38 is normally urged by the spring 39 to move downwardly until the projection 38*a* is pressed against a lower shoulder of the guide groove 37. While the presser pad 38 is urged to the lower position, the lower end 38*c* of the presser pad 38 does not project downwardly beyond the lower edge of the upper cutter blade 30, as shown in FIG. 5A. Both the lower end 30*a* of the upper cutter blade 30 and the lower end 38*c* of the pressure pad 38 are normally disposed slightly above the path of the fastener chain FC', as shown in FIG. 5A.

As shown in FIGS. 1 and 5, a lower cutter blade 31 has the movable member 80, having vertical rack 82, secured by a screw 81 to its downstream surface. An actuator lever 83 is mounted on a shaft 85 rotatably supported on a frame member 9*c* and has an arcuate toothed surface 84 held in meshing engagement with the rack 82. A drive lever 86 is connected at one end to a piston rod C6*a* of a fluid-pressurized cylinder C6 and at the other end to the shaft 85.

Figure 5B:
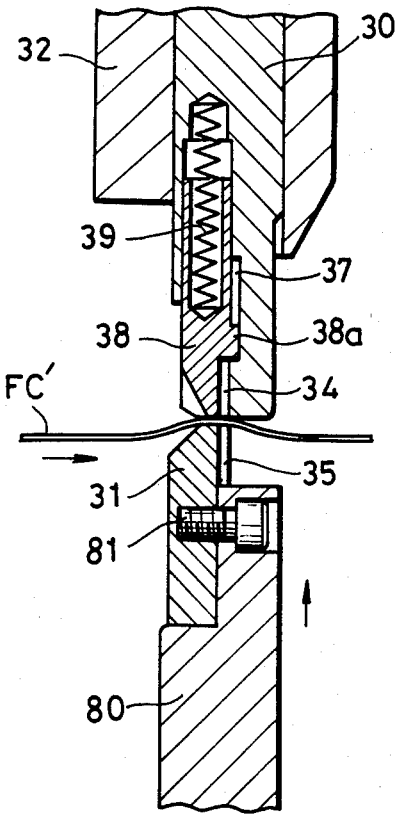
Figure 5C:
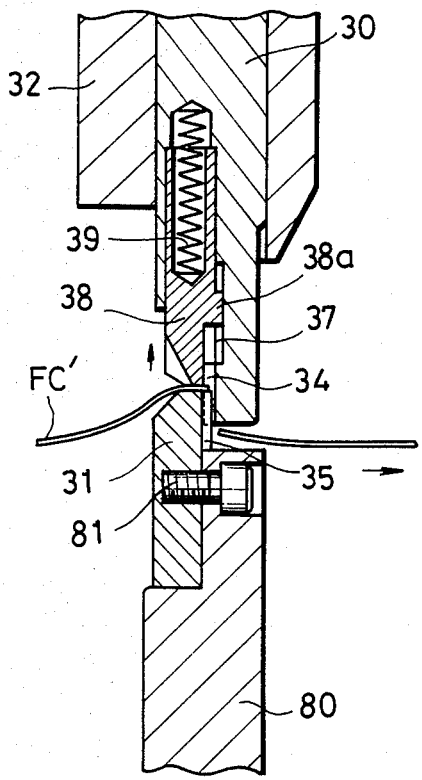
Figure 5D:
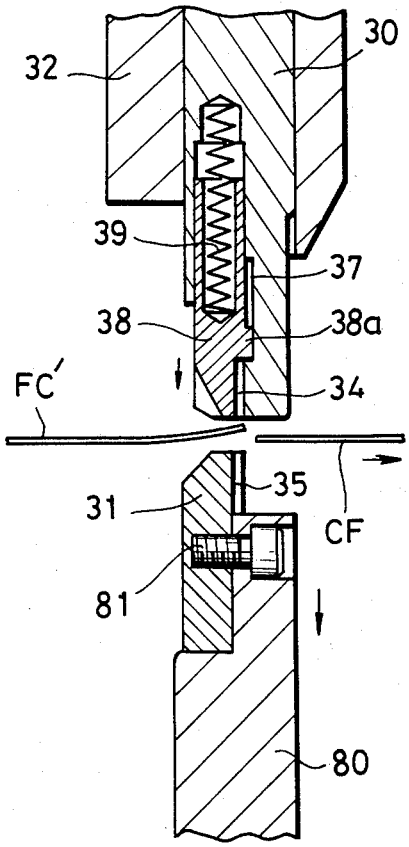

The cutter edge 35 of the lower cutter blade 31 is normally withdrawn from the chain path CP and hence the fastener chain FC' (FIG. 5A). When the piston rod of the cylinder C6 is moved upwardly in response to the actuation of the cylinder C6, the drive lever 86, the shaft 85, and the actuator lever 83 are turned clockwise (FIG. 1) to raise the lower cutter blade 31 until the cutter edge 35 projects into the chain path CP upstream of the cutter edge 34 of the upper cutter blade 30, thus displacing the presser pad 38 upwardly (FIG. 5B).

The drive lever 86 has a first sensor plate 87 and a second sensor plate 88 located adjacent to the piston rod of the fluid cylinder C6. When the piston rod of the cylinder C6 reaches an upper stroke end, an upper limit switch S4 is actuated by the first sensor plate 87. When the piston rod of the cylinder C6 reaches a lower stroke end, a lower limit switch S5 is actuated by the second plate 88. Thus, the limit switch S4 detects when the lower cutter blade 31 has been moved upwardly, and the limit switch S5 detects when the lower cutter blade 31 has been moved downwardly.

Figure 6:
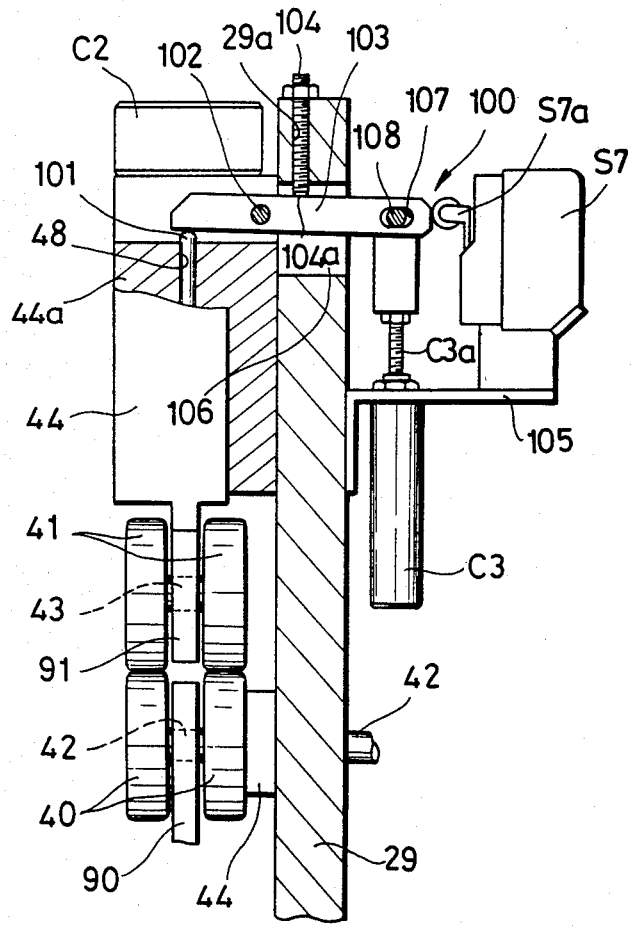
FIG. 6 is a side elevational view, partly in cross section, of a position limiting mechanism.

As shown in FIGS. 1 and 6, the first feeder mechanism 4 comprises a pair of lower feed rollers 40 mounted on a drive shaft 42 and a pair of upper press rollers 41 mounted on a shaft 43. The feed and press rollers 40, 41 are held against the tapes of the slide fastener chain FC, and the feed rollers and the press rollers of each pair are spaced laterally from each other by a distance at least equal to the width of the sliders 114 so that the feed and press rollers 40, 41 will not contact the sliders 114. As shown in FIG. 6, the drive shaft 42 is rotatably supported by and extends through a support wall 29 and a holder 44 fixed to the support wall 29, the drive shaft 42 being connected to a suitable drive source (not shown) such as a motor. The shaft 43 is supported by a movable member 46 vertically movably mounted on the holder 44. The movable member 46 is normally biased to move upwardly by a spring 47 acting between the movable member 46 and the holder 44. Therefore, the press rollers 41 are normally positioned away from the feed rollers 40. The holder 44 supports on its upper end a fluid-pressurized cylinder C2 for lowering the movable member 46.

As illustrated in FIGS. 1 and 6, the holder 44 includes a wide portion 44*a* having a vertical through hole 48. The wider portion 44*a* has a lower end 44*b* held in abutment against a shoulder 46*a* of the movable member 46 for limiting upward movement of the movable member 46.

As shown in FIG. 6, the support wall 29 supports thereon a position limiting mechanism 100 for temporarily stopping upward movement of the press rollers 41, 41 in an intermediate position. The position limiting mechanism 100 is composed of a limit pin 101 movably received in the hole 48 in the wide portion 44*a* of the holder 44, a limit lever 103 tiltably attached by a shaft 102 to an upper portion of the holder 44, an adjustment pin 104 mounted on the support wall 29 for adjusting the position in which the press rollers 41 are to be stopped vertically, a bracket 105 fixed to the support wall 29, a fluid-pressurized cylinder C3 secured to the bracket 105, and a limit switch S7 mounted on the bracket 105.

As shown in FIG. 1, the limit lever 103 has an L-shaped cross section and is held at its lower end against the upper end of the limit pin 101. The limit lever 103 extends laterally through a hole 106 (FIG. 6) in an upper portion of the support wall 29 and has a slot 107 through which a pin 108 extends, the pin 108 being connected to a piston rod C3*a* of the cylinder C3.

The adjustment pin 104 (FIG. 6) comprises an externally threaded rod threadedly extending through an internally threaded aperture 29*a* in the support wall 29 and has a lower end 104*a* projecting into the hole 106 and held against an upper surface of the limit lever 103. The position in which the press rollers 41 are to be stopped moving in a vertical direction can be adjusted by turning the adjustment pin 104 to vary the length of its lower end portion projecting into the hole 106, thereby adjusting the angular range in which the limit lever 103 can be tilted about the shaft 102.

The limit switch S7 has an actuator rod S7*a* which is held in contact with an end of the limit lever 103 when the upper surface of the latter is engaged by the lower end 104*a* of the adjustment pin 104 to limit the upward movement of the press rollers 41 when the piston rod C3*a* projects from the cylinder C3. When the piston rod C3*a* is retracted to position the limit lever 103 out of engagement with the adjustment pin 104, the press rollers 41 are allowed to move upwardly, thus causing the actuator rod S7*a* to disengage from the limit lever 103. When the position limiting mechanism 100 is actuated, the press rollers 41 are vertically spaced slightly from the feed rollers 40 so as not to press the tapes of the slide fastener chain against the feed rollers 40.

As shown in FIG. 1, the first feeder mechanism 4 also includes a pair of lower and upper tilt plates 90, 91 which jointly constitutes a chain closing mechanism. The lower tilt plate 90 is rotatably mounted on the drive shaft 42 between the feed rollers 40 (FIG. 6) and is normally urged to turn counterclockwise about the drive shaft 42 under the resilience of a spring 92 acting between the tilt plate 90 and a fixed pin 92*a*. The tilt plate 90 has an upper flat surface 90*a* and an inclined surface 90*b* positioned upstream of the upper flat surface 90*a*. The tilt plate 90 is normally kept, by the spring 92, against a stop bolt 94 threadedly extending through a support 93 to maintain the upper flat surface 90*a* parallel to the chain path CP.

The upper tilt plate 91 is rotatably mounted on the shaft 43 between the press rollers 41 and is normally urged to turn clockwise about the shaft 43 under the bias of a spring 95 acting between the tilt plate 91 and the movable member 46. The tilt plate 91 has a lower flat surface 91*a* and an inclined surface 91*b* positioned upstream of the upper flat surface 91*a*. The tilt plate 91 is normally kept, by the spring 95, against a stop bolt 96 threadedly extending through the movable member 46 to maintain the lower flat surface 91*a* parallel to the chain path CP.

When the press rollers 41 are raised to the intermediate position by the position limiting mechanism 100, the flat surfaces 90*a*, 91*a* of the tilt plate 90, 91 are vertically spaced from each other by a distance large enough to allow the element rows 113 to move and small enough to block the passage of the slider 114.

The tilt plate 90 supports on its lower end a slider stop 97 in the form of a bolt threadedly extending through and having a bolt head engageable with an actuator rod S6*a* of a limit switch 56. When the tilt plate 90 is turned clockwise (FIG. 1) in response to engagement with a slider 114, the slider stop 97 disengages from the actuator rod S6*a* which actuates the limit switch S6 to detect the slider 114.

A photosensor PS1 is disposed in the chain path CP between the cutting mechanism 3 and the first feeder mechanism 4 so as not to interfere with the travel of the slide fasteners along the chain path CP as they are severed off the slide fastener chain FC.

As shown in FIG. 1, the second feeder mechanism 5 comprises a pair of lower feed rollers 50 mounted on a drive shaft 52 and a pair of upper press rollers 51 rotatably mounted on a shaft 53. The drive shaft 52 is driven by a drive source (not shown) such as a motor for rotating the feed rollers 50 at a speed higher than that of the feed rollers 40 of the first feeder mechanism 4. Although not shown, the upper feed rollers 50 and the lower press rollers are laterally spaced by a distance slightly greater than the width of the sliders 114.

The shaft 53 is mounted on a movable member 55 vertically movably supported on a holder 54. The movable member 55 is normally urged to move upwardly by a spring 56 acting between the movable member 55 and the holder 54, thereby displacing the upper press rollers 51 away from the lower feed rollers 50. The holder 54 supports thereon a fluid-pressurized cylinder C4 for lowering the movable member 55 against the bias of the spring 56.

A photosensor PS2 is disposed in the chain path CP immediately downstream of the second feeder mechanism 5 so as not to interfere with the travel of the slide fasteners along the chain path CP as they are fed by the second feeder mechanism 5.

Figure 7:
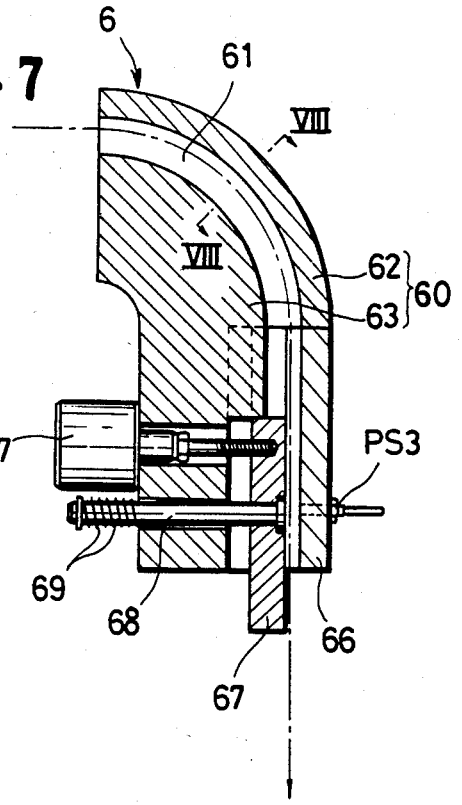
FIG. 7 is a cross-sectional view of a sorting mechanism.
Figure 8:
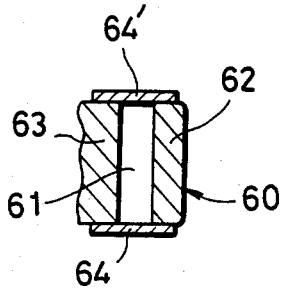
FIG. 8 is a cross-sectional view taken along line VIII—VIII of FIG. 7.

As shown in FIGS. 1, 7 and 8, the sorting mechanism 60 includes a chain guide 60 having therein an arcuate guide passage 61 for guiding the severed slide fasteners downwardly that have been discharged horizontally from the second feeder mechanism 5. As illustrated in FIG. 8, the chain guide 60 includes two guide members 62, 63 spaced from each other by a distance large enough to allow the passage of the sliders 114, the two guide members 62, 63 being interconnected by a pair of side plates 64, 64'. The guide passage 61 is defined jointly by the guide members 62, 63 and the side plates 64, 64'. The sorting mechanism 60 also includes a fixed guide 65 (FIG. 9) with an elongate fixed guide lever 66 secured thereto and a movable guide lever 67 (FIG. 7) disposed in confronting relation to the fixed guide lever 66 across the guide passage 61. The fixed guide 65 is secured to the guide member 62, while the movable guide lever 67 is mounted on the guide member 63. The movable guide lever 67 is supported by a guide pin 68 slidably mounted on the guide member 63 and is normally urged, by a spring 69 disposed around the guide pin 68, away from the fixed guide lever 66 by a distance large enough to allow the sliders 114 to pass between the fixed and movable guide levers 66, 67, as shown in FIG. 1.

A fluid-pressurized cylinder C7 is mounted on the guide member 63 and has a piston rod C7*a* coupled to the movable guide lever 67 for moving the movable guide lever 67 toward the fixed guide lever 66 to narrow the guide passage 61, as shown in FIG. 7, to allow the passage of the element rows 113 and to prevent the sliders 114 from passing therethrough.

The fixed guide 65 supports a photosensor PS3 in a position so as not to interfere with the travel of slide fasteners through the guide passage 61.

Figure 9:
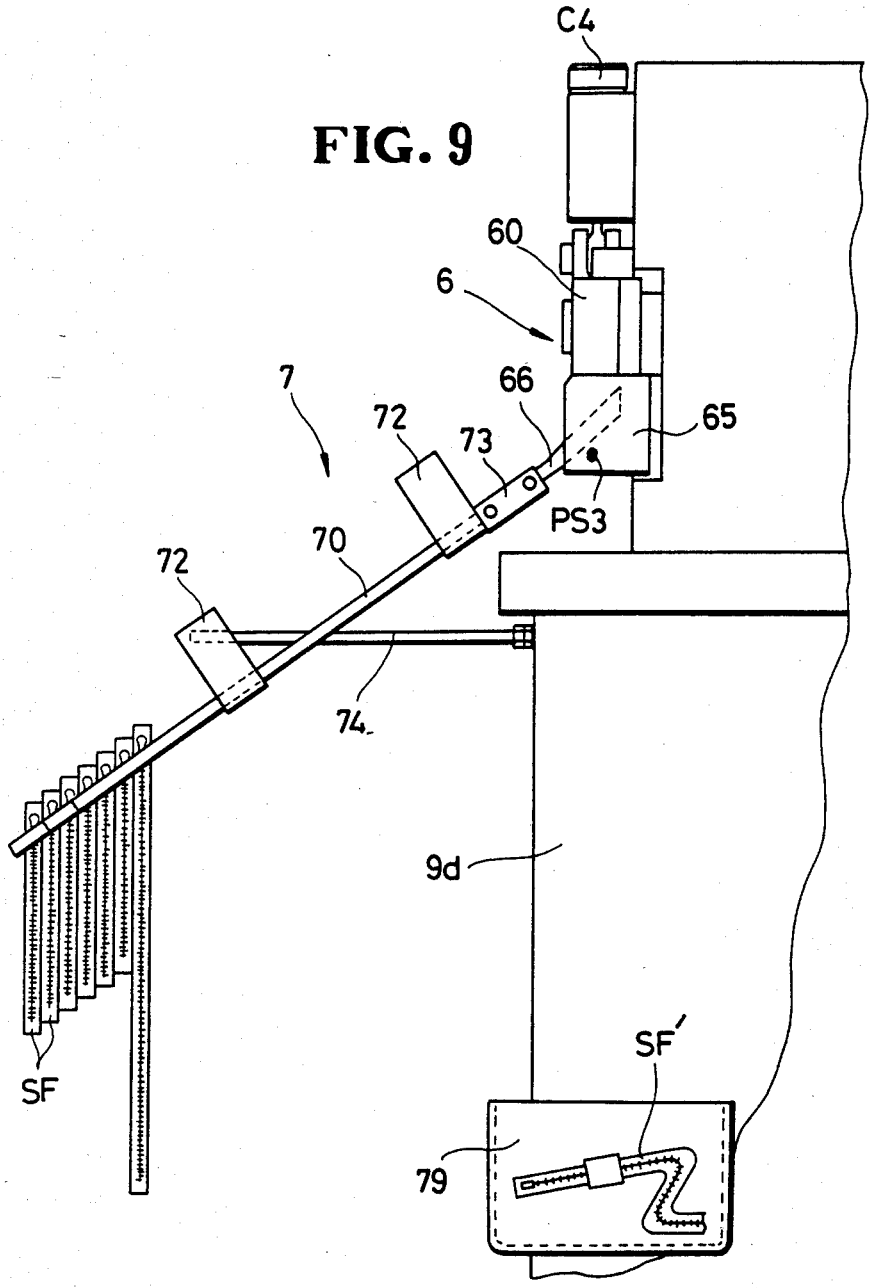
FIG. 9 is a side elevational view of a storage mechanism.
Figures 10, 11:
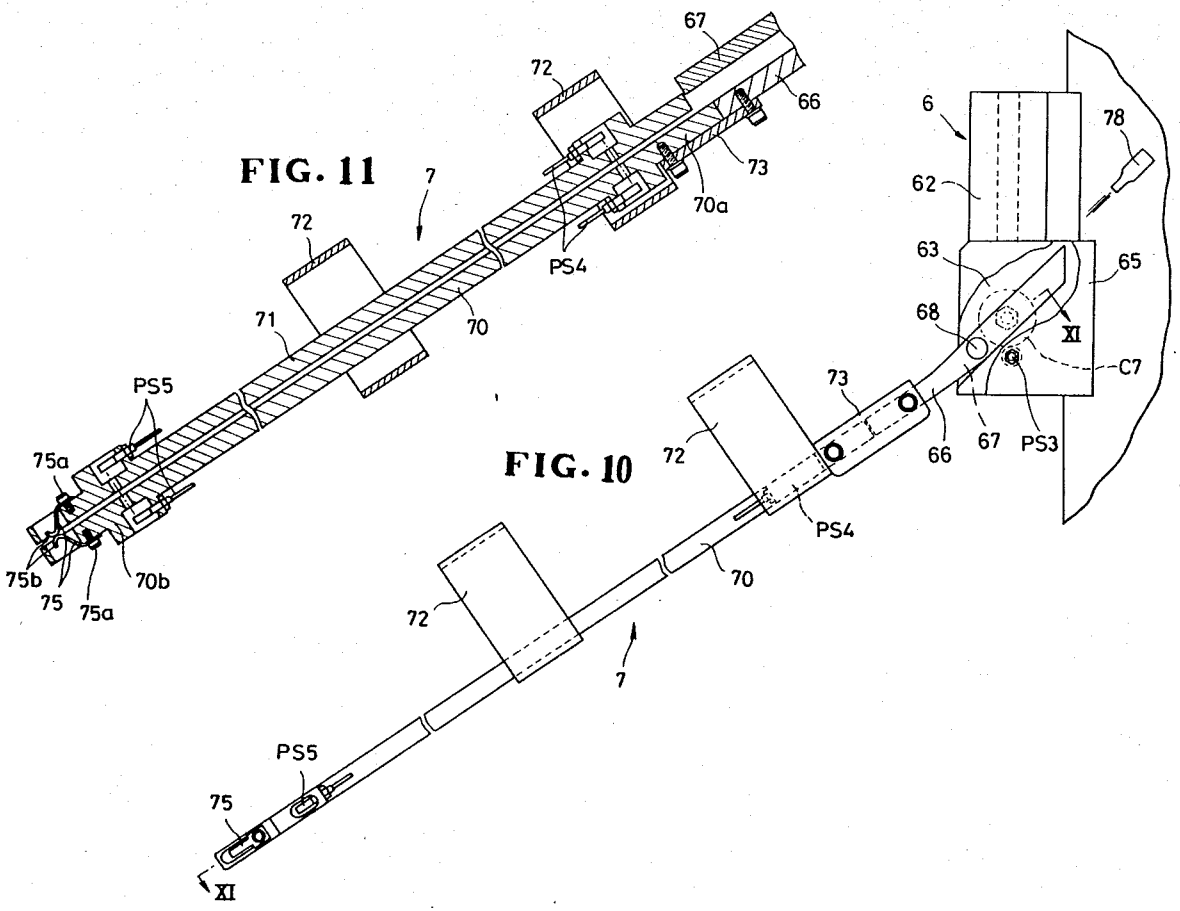
FIG. 10 is an enlarged side elevational view of the storage mechanism of FIG. 9.
FIG. 11 is a cross-sectional view taken along line XI—XI of FIG. 10.

As illustrated in FIGS. 9 through 11, the fixed and movable guide levers 66, 67 are inclined with respect to the vertical plane, and have their upper surfaces aligned with each other. When the guide passage 61 between the guide levers 66, 67 is narrowed in response to actuation of the cylinder C7, the slider 114 on a slide fastener transported downwardly through the guide passage 61 engages the upper surfaces of the guide levers 66, 67, and the slider 114 is guided along the guide levers 66, 67 into the storage mechanism 7. Any defective slide fastener, which has no slider mounted thereon, will be dropped by the movable guide lever 67 into a box 79 (FIG. 9), as described below.

Slide fasteners are normally moved downwardly along the guide levers 66, 67 by gravity. An air nozzle 78 (FIG. 10) may be provided for blowing air toward the guide levers 66, 67 to assist the slide fasteners in travelling downwardly along the guide levers 66, 67.

The storage mechanism 7 comprises a pair of inclined stock bars 70, 71 for receiving slide fasteners having been guided from the guide levers 66, 67, as shown in FIGS. 9 through 11. The stock bars 70, 71 are interconnected by a pair of upper and lower connectors 72, 72 and spaced from each other by a distance to allow the passage of the element rows 113 between the stock bars 70, 71 and to prevent the sliders 114 from entering between the stock bars 70, 71. The stock bar 70 has an upper end 70*a* fastened by a connector 73 to the fixed guide lever 66. The stock bars 70, 71 are kept in the inclined position by a support bar 74 (FIG. 9) mounted between the lower connector 72 and a frame member 9*d*. As shown in FIGS. 10 and 11, a photosensor PS4 is disposed on the stock bars 70, 71 at their upper inlet end close to the sorting mechanism 6. The stock bars 70, 71 have a lower outlet end 70*b* from which the stored slide fasteners SF are picked up, the lower outlet end 70*b* having a pair of leaf springs 75, 75 for preventing the stored slide fasteners SF from falling from the stock bars 70, 71. The leaf springs 75, 75 are fastened at their one end to the stock bars 70, 71 by screws 75*a*, 75*a*, respectively, and have distal ends 75*b* resiliently pressed against each other. A photosensor PS5 is also mounted on the stock bars 70, 71 at the lower outlet end 70*b*.

The cylinders C1, C2, C3, C4, C5, C6, C7 used in the apparatus may comprise known hydraulic or pneumatic cylinders. Each of the photosensors PS1, PS2, PS3, PS4, PS5 is of a known structure composed of a light-emitting element, such as a light-emitting diode, and a photodetector such as a phototransistor.

Operation of the apparatus of the foregoing construction is as follows:

Prior to the start of operation of the apparatus, the slide fastener chain FC is set in the apparatus with the pull tabs 115 on the sliders 114 facing downwardly and the bottom stops 112 ahead of the top stops 111 in the direction of travel along the chain path CP. The slide fastener chain FC extends along the chain guide 8 and the guide groove 15 with the leading end positioned in the cutting mechanism 3. The feedout mechanism 1 is in the retracted position that is detected by the first reed switch RS1. As the cylinder C1 is actuated, the piston rod C1*a* projects to turn the grippers 12, 12 until the tapes 110 of the slide fastener chain FC are gripped between the grippers 12 and the bearing plate 14.

Figure 12:
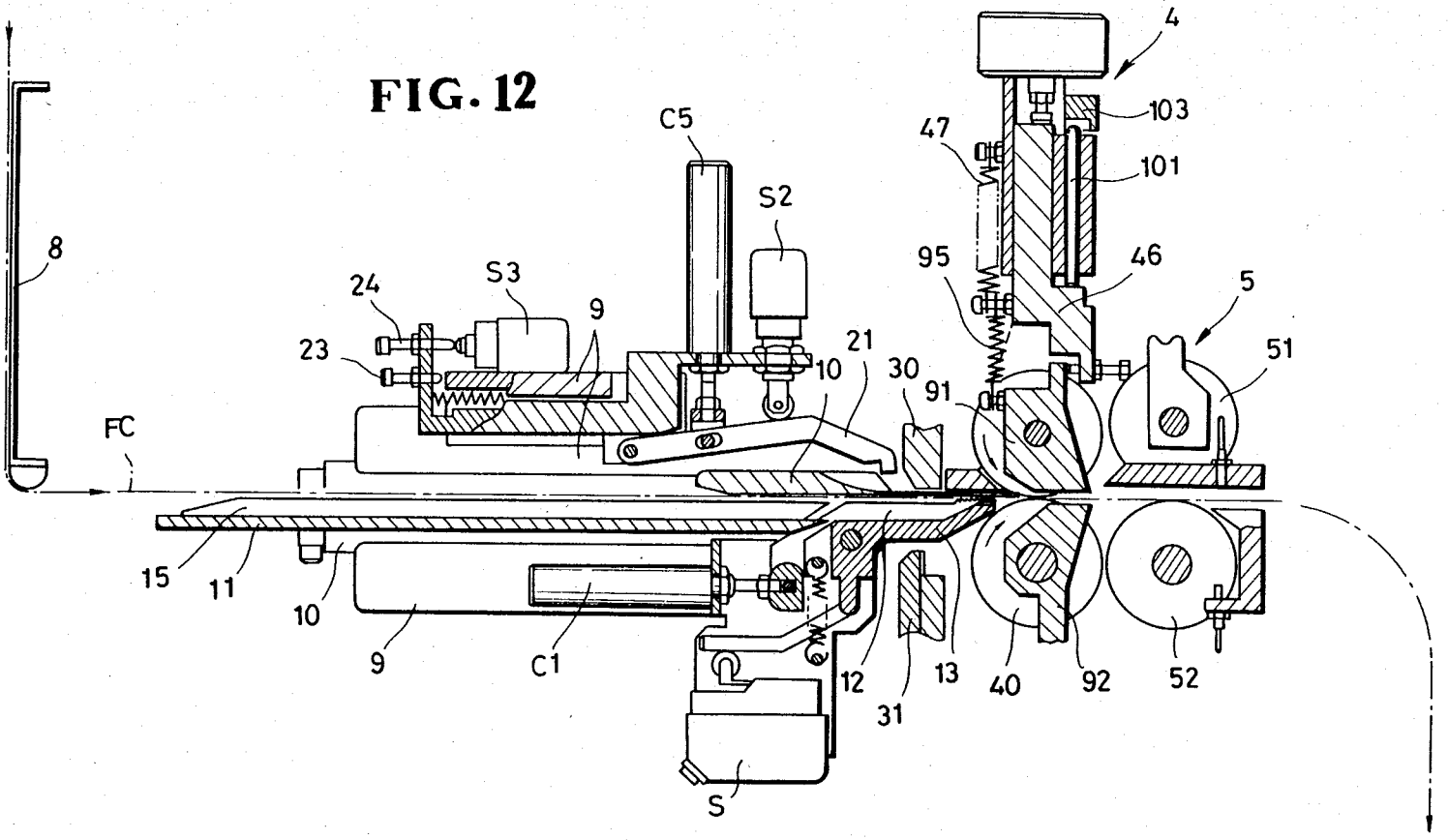
FIG. 12 is a vertical cross-sectional view showing the manner in which the feedout mechanism and a first feeder mechanism operate.

As the sensor cylinder SC is then actuated, the feedout mechanism 1 advances to the position of FIG. 12 to move the leading end of the slide fastener chain FC past the cutting mechanism 3 to the first feeder mechanism 4.

The arrival of the leading end of the slide fastener chain FC at the first feeder mechanism 4 is detected by the reed switch RS2 mounted on the sensor cylinder SC, whereupon the cylinders C1, SC are actuated to retract their piston rods. In response to the issue of a signal from the reed switch RS2, the slide fastener chain FC is released from the grippers 12 and the bearing plate 14, and the feedout mechanism 1 is retracted. At the same time, the cylinder C2 is actuated to lower the movable member 46, causing the feed rollers 40 and the press rollers 41 to grip and feed the slide fastener chain FC along the chain path to the second feeder mechanism 5.

Substantially concurrently when the cylinder C2 is thus actuated, the cylinder C3 is also actuated to turn the limit lever 103 to the position of FIG. 6. At that time, the limit pin 101 and the limit lever 103 are slightly spaced from each other, as illustrated in FIG. 12. The position of the limit lever 103 is detected by the limit switch S7. When the leading end of the slide fastener chain FC is detected by the photosensor PS2 while the limit switch S7 is being actuated by the limit lever 103, the cylinder C4 is actuated to lower the movable member 55 of the second feeder mechanism 5. At this time, the slide fastener chain FC is fed along at a speed higher by the feed rollers 50 and the press rollers 51.

Concurrently with the actuation of the cylinder C4, the cylinder C2 is actuated again to retract its piston rod, thus allowing the press rollers 41 to move upwardly under the resilience of the spring 47. Since the position limiting mechanism 100 has already been in operation, the press rollers 41 are kept slightly spaced from the feed rollers 40 by a distance large enough to allow the passage of the tapes 110 and to prevent the movement of slider 114.

When the slider 114 is engaged by the slider sensor 13 as the slide fastener chain FC is fed by the second feeder mechanism 5, the slider 114 is blocked by the slider sensor 13 against downstream movement, thereby intermeshing the uncoupled elements 113 on the slide fastener chain FC as the latter travels. Thereafter, the slider 114 moves past the slider sensor 13, forcing the latter to turn clockwise (FIG. 1) about the shaft 16 against the force of the spring 17.

In response to the issue of a signal from the limit switch S1 actuated by the clockwise movement of the slider sensor 13, the cylinder C5 is actuated to lower the distal end 21*a* of the chain stop 21 of the stop mechanism 2. The distal end 21*a* of the chain stop 21 projects downwardly through the recess 19 in the bearing plate 14 across the chain path CP into an element-free gap or a space between any remaining uncoupled element rows. When the following bottom stop 112 is brought into abutment with the chain stop end 21*a*, the stop mechanism 2 starts moving downstream in response to the travel of the slide fastener chain FC until the stop bolt 23 is engaged by the second stop surface 9*b* of the frame 9, whereupon the stop mechanism 2 stops its movement and thus the travel of the slide fastener chain FC.

When the advancing movement of the stop mechanism 2 is detected by the limit switch S3, the cylinder C4 withdraws its piston rod, thus allowing the press rollers 51 to be lifted away from the feed rollers 50 under the resilience of the spring 56, whereupon the slide fastener chain FC is released. Then the stop mechanism 2 is enabled by the spring 22 to move back, causing the chain stop end 21*a* to pull back the slide fastener chain FC to the extent to which the stop mechanism 2 is moved back.

When the retraction of the stop mechanism 2 is detected by the limit switch S3, the cylinder C6 is actuated to raise the lower cutter blade 31 of the cutting mechanism 3 across the chain path CP. At that time, the lower cutter blade 31 is raised from the position of FIG. 5A first to the position of FIG. 5B, in which its upper end is disposed against the lower end of the pressure pad 38, and then to the position of FIG. 5C, in which the cutter edge 35 of the cutter blade 31 lifts the pressure pad 38 having been engaged with the cutter edge 34 of the upper cutter blade 30. As a result, the slide fastener chain FC is cut off across an element-free gap between longitudinally spaced and adjacent element rows 113, the cut edges being of a serrated shape.

When the slide fastener chain FC is cut off by the lifted lower cutter blade 31, the limit switch S4 issues a signal for actuating the cylinder C6 to lower the lower cutter blade 31 below the chain path CP. Simultaneously, the cylinder C5 retracts the chain stop 21 back to the upper position for allowing the slide fastener chain FC to move along the chain path CP. During that time, the lower cutter blade 31 is lowered from the position of FIG. 5C, in which the leading end of the fastener chain FC is lifted from the chain path CP to contact with the cutter edge 34 of the upper cutter blade 30, to the position of FIG. 5D in which the fastener chain FC is forcibly returned to the chain path CP.

The downward movement of the lower cutter blade 31 is detected by the limit switch S5, which actuates the cylinder C4 again to enable the press rollers 51 and the feed rollers 50 to coact to discharge the cut slide fastener into the sorting mechanism 6.

The remaining uncoupled elements 113 on the slide fastener as the latter is thus discharged are intermeshed by the slider 114 that is engaged by the tilt plates 90, 91. Thereafter, the tilt plates 90, 91 are turned about the shafts 43, 42 by the slider 114 as it moves past the inclined surfaces 90*b*, 91*b* of the tilt plates 90, 91. The movement of the slider 114 past the tilt plates 90, 91 is detected by the limit switch S6, which then actuates the cylinder C3 to retract its piston rod C3*a*, thereby releasing the position limiting mechanism 100. Accordingly, the press rollers 41 are moved upwardly under the resilience of the spring 95.

Substantially concurrently with that the slide fastener is discharged by the second feeder mechanism 5, the cylinders C1, SC are actuated again to feed out the slide fastener chain FC along the chain path CP. The foregoing cycle of operation will be repeated until a predetermined number of slide fasteners are cut off.

Severed slide fasteners having been fed from the second feeder mechanism 5 are discharged through the arcuate passage 60 into the sorting mechanism 6. When the trailing end of a slide fastener entering the sorting mechanism 6 is detected by the photosensor PS2, the cylinder C7 is actuated to move the movable guide lever 67 toward the fixed guide lever 66, as shown in FIG. 7, to reduce the width of the guide passage 61. Any defective slide fasteners, having no sliders, are allowed to pass through the guide passage 61 into the box 79. At the same time, complete slide fasteners with sliders 114 are prevented from falling because of engagement of the sliders 114 with the guide levers 66, 67, and are guided down the guide levers 66 by gravity and/or the air blower 78 in response to the issue of a signal from the photosensor PS3 which detects the slide fasteners.

The slide fastener, as it enters the storage mechanism 7, is detected by the photosensor PS4, which issues a count signal. The number of slide fasteners stored in the storage mechanism 7 can be determined by the number of count signals issued from the photosensor PS4.

The slide fasteners transported into the storage mechanism 9 are stopped by the leaf springs 75, as shown in FIG. 9, hanging with the sliders 114 engaged by the upper surfaces of the stock bars 70, 71. A desired number of stored slide fasteners can then be pick up from the storage mechanism 7 by the worker.

The photosensor PS5 on the stock bars 70, 71 at their outlet end serves to detect any remaining slide fasteners on the stock bars when the finishing apparatus A is to be started again.

A single slide fastener chain from which slide fastners are cut off is usually several tens meters long. For processing such a slide fastener chain with the finishing apparatus A, it is a usual practice to use a plurality of such slide fastener chains interconnectd in series for continuous production of slide fasteners; the individual slide fastener chains are joined end-to-end by staples, and a metal tape is applied to each joint. Any slide fastener lengths including such joined chain ends are defective, and therefore should be rejected before they are delivered into the storage mechanism 7.

To reject the defficient slide fasteners, the metal tape at the joined chain ends is detected by the photosensor PS1 (FIG. 1), and a signal from the photosensor PS1 is employed to reduce the count in a product counter by one, or inhibit a signal from the photosensor PS4 to the product counter. At the same time, the signal from the photosensor PS1 is applied to an arithmetic control unit (not shown) to produce a signal for rendering the cylinder C7 inoperative to allow a slide fastener length with the metal tape to fall into the box 79 as a defective slide fastener SF′ (FIG. 9). Accordingly, only defect-free slide fasteners SF can be stored in the storage mechanism 7.

A defective slide fastener length that contains joined chain ends is usually longer than a complete slide fastener. Therefore, even when an unwanted slide fastener length SF′ is delivered in error into the storage mechanism 7, it can be marked by the worker for removal.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A method of automatically finishing slide fasteners, comprising the steps of:

(a) feeding an elongate slide fastener chain with a feedout mechanism by gripping a leading end of said chain along a chain path past a cutting mechanism;

(b) feeding said slide fastener chain with a first feeder mechanism (4) disposed downstream of said cutting mechanism along said chain path while inactivating said feedout mechanism;

(c) feeding said slide fastener chain with a second feeder mechanism disposed downstream of said first feeder mechanism along said chain path while inactivating said first feeder mechanism;

(d) stopping a slider on said slide fastener chain with respect to the movement thereof along said chain path to intermesh a pair of rows of coupling elements thereon while said chain is being fed by said second feeder mechanism;

(e) engaging a bottom stop on said slide fastener chain adjacent to said rows of coupling elements to stop the movement of said chain;

(f) inactivating said second feeder mechanism simultaneously with said engaging step (e); and (g) cutting off said chain across an element-free gap adjacent to said bottom stop to produce a slide fastener.

2. A method according to claim 1, said slide fastener chain (FC) being cut off subsequently to said engaging step (e).

3. A method according to claim 2, said slide fastener chain being moved back when said second feeder mechanism is inactivated, and thereafter said slide fastener chain being cut off.

4. An apparatus for automatically finishing slide fasteners by cutting off an elongate slide fastener chain having a plurality of pairs of rows of coupling elements longitudinally spaced by element-free gaps and sliders slidably mounted on the rows of coupling elements, said apparatus comprising:

(a) a cutting mechanism for cutting off the slide fastener chain across one of the element-free gaps to produce a slide fastener;

(b) a first feeder mechanism disposed downstream of said cutting mechanism for feeding the slide fastener chain along a path of travel;

(c) a second feeder mechanism disposed downstream of said first feeder mechanism for feeding the slide fastener chain along said path of travel;

(d) a feedout mechanism disposed upstream of said cutting mechanism for feeding the slide fastener chain by gripping a leading end thereof past said cutting mechanism to said first feeder mechanism;

(e) means disposed upstream of said cutting mechanism for engaging one of the sliders while the slide fastener chain is being fed by said second feeder mechanism, thereby intermeshing one of the pairs of rows of coupling elements; and (f) a stop mechanism disposed upstream of said cutting mechanism and having a chain stop insertable into one of the element-free gaps adjacent to said one pair of rows of coupling elements to stop the movement of the slide fastener chain along said path of travel, said cutting mechanism being actuatable to cut off the slide fastener chain in response to operation of said stop mechanism.

5. An apparatus according to claim 4, said cutting mechanism comprising a fixed cutter blade positioned on one side of said path of travel, a movable cutter blade positioned on an opposite side of said path of travel and movable toward and away from said fixed cutter blade across said path of travel, and drive means for driving said movable cutter blade toward said fixed cutter blade across said path of travel in response to operation of said stop mechanism.

6. An apparatus according to claim 5, said drive means comprising a holder, a movable member slidably supported on said holder and having a rack, an angularly movable actuator lever having an arcuate toothed surface held in driving mesh with said rack, a drive lever coupled to said actuator lever, and a fluid-pressurized cylinder having a piston rod operatively connected to said drive lever for angularly moving said drive lever.

7. An apparatus according to claim 6, said movable member being movable between a first position in which said movable cutter blade coacts with said fixed cutter blade to cut off the slide fastener chain and a second position in which said movable cutter blade is retracted away from said fixed cutter blade, said drive means further comprising a first sensor plate mounted on said drive lever, a second sensor plate mounted on said drive lever, a first limit switch actuatable by said first sensor plate in response to arrival of said movable member at said first position for acuating said cylinder to move said movable member away from said first position to said second position and lifting said chain stop out of said element-free gap to release the slide fastener chain, and a second limit switch actuatable by said second sensor plate in response to arrival of said movable member at said second position for energizing said second feeder mechanism to discharge the slide fastener.

8. An apparatus according to claim 4, said fixed and movable cutter blades having cutter edges of complementary serrated configurations.

* * * * *